US006470700B1

(12) United States Patent
Qiu et al.

(10) Patent No.: US 6,470,700 B1
(45) Date of Patent: Oct. 29, 2002

(54) REDUCED NOISE GRILL

(75) Inventors: Yuan Qiu; Philip Lavrich, both of Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/053,947

(22) Filed: Jan. 24, 2002

(51) Int. Cl.[7] ..... F25D 19/00
(52) U.S. Cl. ..... 62/296
(58) Field of Search ..... 62/296; 181/224, 181/225, 229, 210; 454/201, 254, 276

(56) References Cited

U.S. PATENT DOCUMENTS 2,080,595 A * 5/1937 Anderson et al. ..... 62/296
5,274,201 A * 12/1993 Steele ..... 181/224
5,725,427 A * 3/1998 Koerber ..... 454/296

FOREIGN PATENT DOCUMENTS

DE 003618653 A1 * 12/1987 ..... 181/210
JP 04041804 A * 2/1992 ..... 181/210

* cited by examiner

*Primary Examiner*—William E. Tapolcai
*Assistant Examiner*—Mohammad M. Ali
(74) *Attorney, Agent, or Firm*—William F. White

(57) ABSTRACT

A grill for an air conditioning unit has one or more grill members wrapped with wire so as to present a varying topographical surface to the flow of air over the grill members. The resulting grill member profile that is presented to the air flow reduces vortex shedding noise that would otherwise occur without the wire wrapping. Various wire wrappings are disclosed which produce the desired effect of reducing the vortex shedding noise.

8 Claims, 3 Drawing Sheets

REDUCED NOISE GRILL

BACKGROUND OF THE INVENTION

This invention relates to the flow of air through the grill of an air conditioning unit and in particular to reducing the noise level produced by such air flow.

Air conditioning units, including heat pump units, typically include grill structure which prevents entry of foreign objects into the unit while allowing the free flow of air. The flow of air is into the unit if it is the condensing unit or section of an air conditioning system. The flow of air is out of the unit if it is an evaporating unit.

A fan normally defines the flow of air into or out of the unit. Today's fans are capable of producing a high flow of air through the grill. This may result in unacceptable noise levels as the air flows through the grill structure. It would be preferable to have a grill structure which would lower these unacceptable noise levels.

SUMMARY OF THE INVENTION

A grill for an air conditioning unit is provided which reduces the level of noise produced by the flow of air through the grill. The grill may be of any shape necessary to accommodate the particular unit in which it is installed. The grill preferably has one or more grill members wrapped with wire so as to present a varying topographical surface to the flow of air over the grill member. The wire wrapping may be formed in various ways including twisted strands of wire thereafter wrapped around the one or more grill members. The wire may also be a single piece of wire having spaced protrusions so as to disrupt the flow of air when wrapped around one or more grill members. Another embodiment is a round wire that is flattened at various intervals so as to present a discontinuous shaped wire wrapped around one or more grill members.

BRIEF DESCRIPTION OF THE DRAWINGS

Further advantages of the present invention will be apparent from the following description in conjunction with the accompanying drawings, in which.

DESCRIPTION OF THE PREFERRED EMBODIMENT

The preferred embodiment described herein refers to a rectangular shaped grill within a rectangular shaped air conditioning unit. It is to be understood however that this invention has like applicability to differently shaped grills in differently shaped air conditioning units including the typical circular shaped grill for the outdoor condensing unit of an air conditioning system or the outdoor evaporator unit of an air heat pump system.

Figure 1:
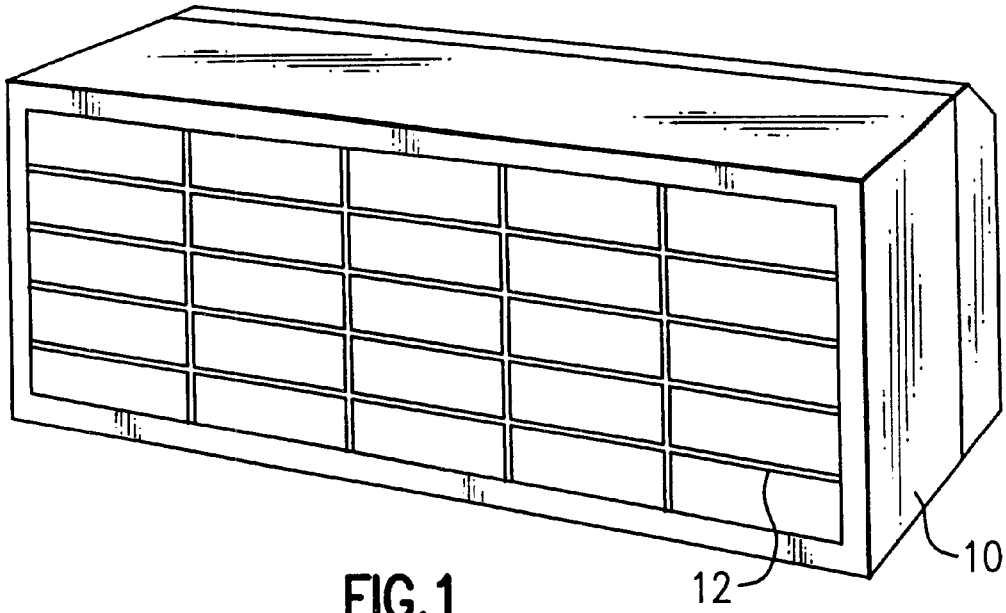
FIG. 1 illustrates an air conditioning unit with a grill mounted therein.

Referring to FIG. 1, an air conditioning unit 10 includes a grill 12 positioned therein. As noted above, the shape of the grill and the shape of the air conditioning unit should not be a limiting feature of the invention.

Figure 2:
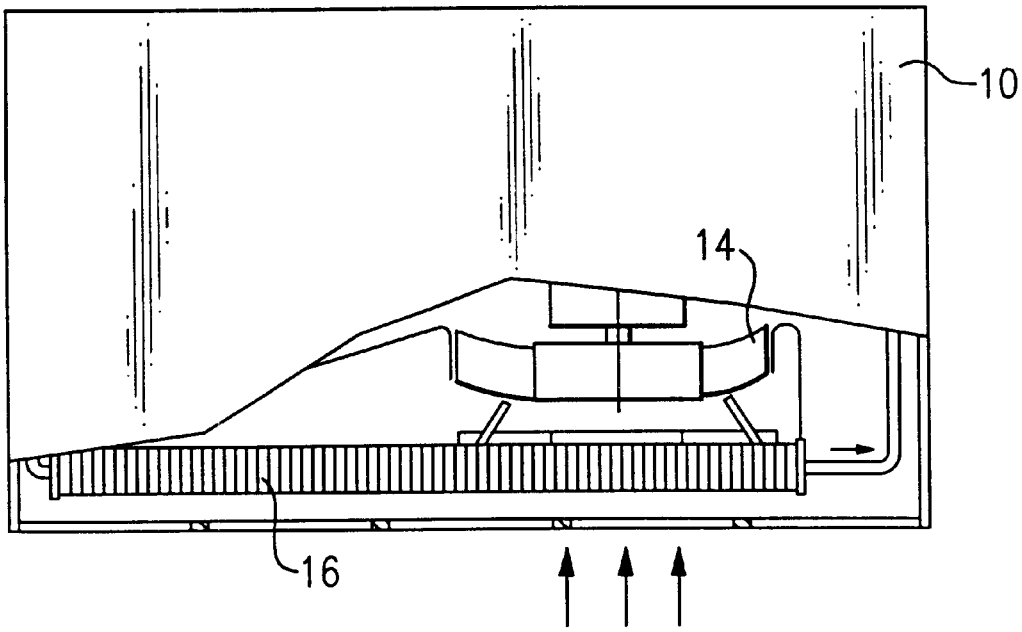
FIG. 2 illustrates an internal fan and heat exchanger configuration within the air conditioning unit of FIG. 1.

Referring to FIG. 2, the air conditioning unit 10 is broken away so as to show a fan 14 drawing air through the grill 12 and hence over a heat exchanger 16. It is to be appreciated that the fan could also move the air in the opposite direction in various types of air conditioning units. The fan 14 produces a significantly high flow of air through the grill 12 so as to require a noise level reduction.

Figure 3:
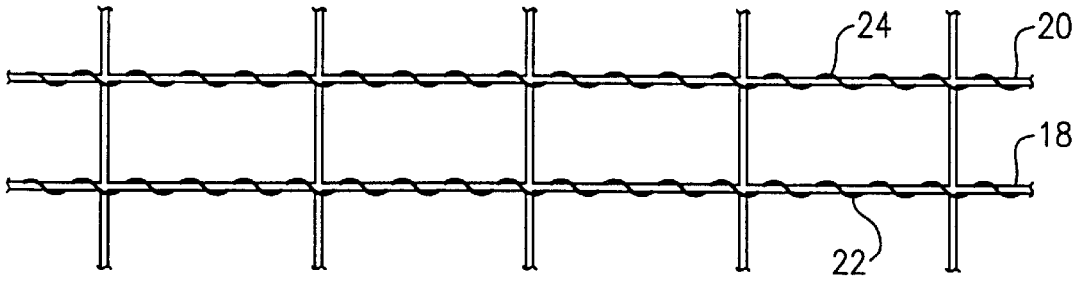
FIG. 3 illustrates a particular wire wrapping of grill members so as to thereby reduce the noise produced by air flow through the grill.

Referring now to FIG. 3, a portion of the grill 12 is shown in further detail. In particular, two horizontal grill members 18 and 20 intersected by a series of vertical grill members are shown. The horizontal grill members 18 and 20 are each wrapped with single pieces of wire 22 and 24. The wrapping of the grill members by the single pieces of wire is such as to produce a significant variation in the grill member profile to the incoming air flow. This variation in the grill member profile reduces the vortex shedding noise that would otherwise be produced by the airflow through the grill 12. It is to be appreciated that the number of wire wrappings per lineal measurement along the lengths of the grill members will vary per application depending on the particular level of air flow produced by the fan 14. The resulting grill member profile to the flow of air should produce various out of phase levels of noise which tend to cancel each other at the particular level of air flow.

Figure 4:
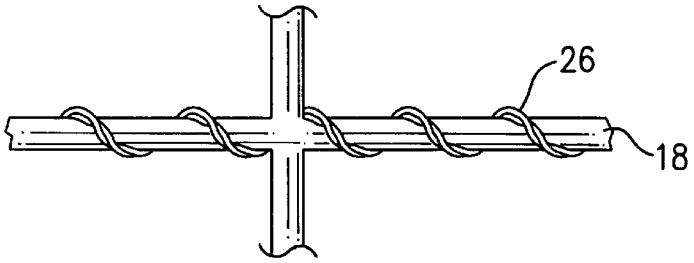
FIG. 4 is an alternative wire wrapping of a member of the grill of FIG. 3.

Referring now to FIG. 4, an alternative wire wrapping of the grill member 18 is illustrated. In particular, the wire 22 is replaced by a twisted pair wire 26 which causes an even further variation in the grill member profile to the incoming air flow through the grill 12. It is to be appreciated that the twisted pair wire wrapping 26 produces a more profound variation in grill member profile to the incoming air than that of the single wire wrapping of FIG. 3. The twisted wire 26 is preferably twisted at least once during each successive wrapping of the member 18 by the twisted wire 26. The number of wire wrappings of the twisted pair wire per lineal measurement along the lengths of the grill members will vary per application depending on the particular level of air flow produced by the fan 14.

Figure 5:
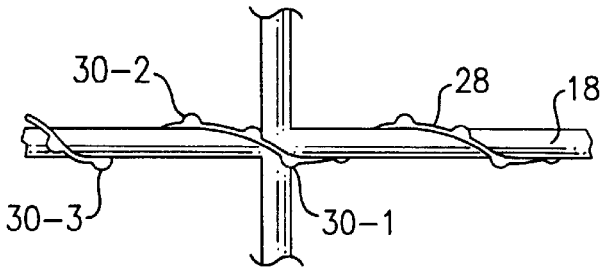
FIG. 5 is yet another alternative wire wrapping of a grill member.

Referring now to FIG. 5, yet another form of wire wrapping of the horizontal member 18 is illustrated. In particular, a wire 28 includes spaced protrusions such as 30-1 through 30-3. The spaced protrusions define a variation in grill member profile to the airflow. The spacing of the protrusions 30-1 to 30-3 may either be uniform or variable. The number of wire wrappings of the wire 28 per lineal measurement along the length of the grill members will vary per application depending on the particular level of air flow produced by the fan 14.

Figure 6:
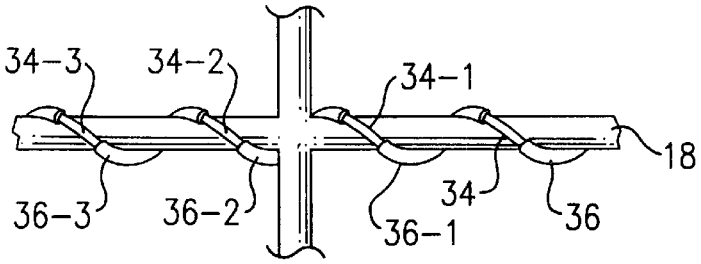
FIG. 6 is yet another alternative wire wrapping of a grill member.

Referring now to FIG. 6, a still further wire wrapping around the horizontal grill member 18 is illustrated. The wire wrapping is preferably formed by flattening various portions of an otherwise circular wire so as to produce flattened sections 34-1, 34-2, 34-3 between otherwise normally shaped wire sections 36-1, 36-2, 36-3. The spacing of the flattened sections 34-1, 34-2, 34-3 between otherwise normally shaped wire sections 36-1, 36-2, 36-3 may either be uniform or variable. The discontinuities produced by this type of wire wrapping again results in a varying grill member profile to the air flow produced by the fan 14. The number of wire wrappings of the alternately flattened wire per lineal measurement along the length of a grill member can again be chosen as to produce the desired break up of the vortex shedding noise otherwise produced by the particular fan moving air over the particular grill.

Figure 7:
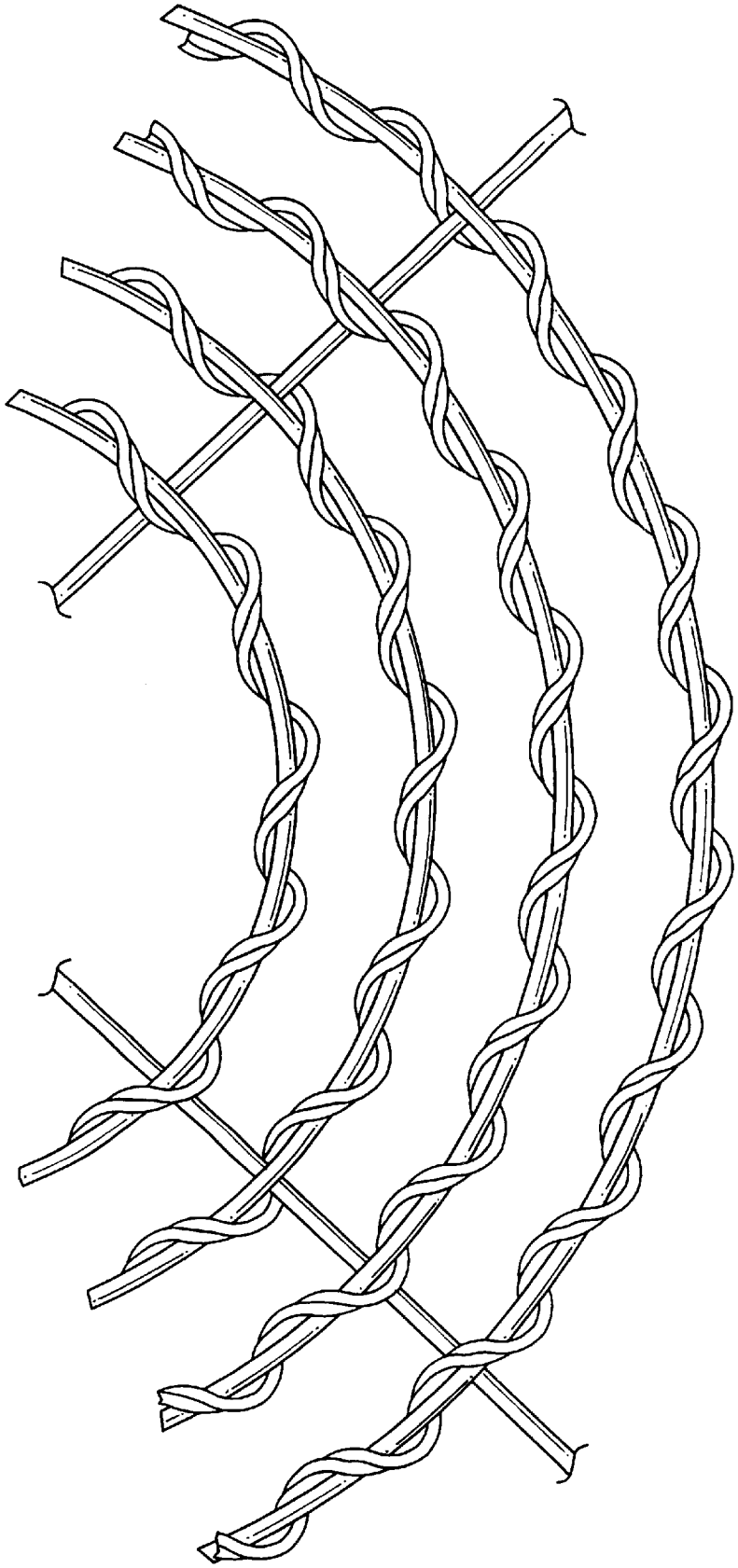
FIG. 7 illustrates a wire wrapping of a differently shaped grill than that shown in FIGS. 1–6.

Referring now to FIG. 7, a wire wrapping of circular grill members of a circular grill is shown. The particular wire wrapping 38 around each circular grill member is preferably the same as the twisted pair wire shown in FIG. 4. It is to be appreciated that the twisted pair wire wrapping of the circular grill members could be replaced with any of the disclosed wire wrappings of FIGS. 3, 5, 6, or any other wire wrapping that would produce the desired break up of the vortex shedding noise otherwise produced by the particular fan moving air over the circular grill.

It is to be appreciated from the above that various embodiments of the invention have been described. Alterations, modifications and improvements thereto can be made within the scope of the invention. For example, many different wire wrappings other than the twisted wire or the other two embodiments of the wire wrapping may be used to wrap the grill member so as to produce the disruptive grill member profile to the flow of air. Accordingly, the forgoing description is by way of example only and the invention is to be limited by the following claims and equivalents thereto.

What is claimed is:

1. An air conditioning unit comprising:

a heat exchanger;

a fan for producing air flow through the heat exchanger; and a grill mounted within the unit so as to be in the path of the air flow produced by the fan, said grill including at least one member wrapped with wire so as to reduce the level of noise that would otherwise occur by the flow of air through the grill.

2. The air conditioning unit of claim 1 wherein the at least one member wrapped with wire comprises:

a grill member wrapped with twisted strands of wire so as to reduce the level of noise that would otherwise occur by the flow of air through the grill.

3. The air conditioning unit of claim 1 wherein the at least one member wrapped with wire comprises:

a grill member wrapped with wire having spaced protrusions so as to reduce the level of noise that would otherwise occur by the flow of air through the grill.

4. The air conditioning unit of claim 1 wherein the at least one member wrapped with wire comprises:

a grill member wrapped with wire having spaced flattened sections between otherwise unflattened sections so as to reduce the level of noise that would otherwise occur by the flow of air through the grill.

5. A grill for an air conditioning unit comprising at least one grill member wrapped with wire so as to reduce the level of noise that would otherwise occur by the flow of air through the grill.

6. The grill of claim 5 wherein the at least one member wrapped with wire comprises:

a grill member wrapped with twisted strands of wire so as to reduce the level of noise that would otherwise occur by the flow of air through the grill.

7. The grill of claim 5 wherein the at least one member wrapped with wire comprises:

a grill member wrapped with wire having spaced protrusions so as to reduce the level of noise that would otherwise occur by the flow of air through the grill.

8. The grill of claim 5 wherein the at least one member wrapped with wire comprises:

a grill member wrapped with wire having spaced flattened sections between otherwise unflattened sections so as to reduce the level of noise that would otherwise occur by the flow of air through the grill.

* * * * *